United States Patent [19]

Kisman et al.

[11] Patent Number: 5,060,730

[45] Date of Patent: Oct. 29, 1991

[54] WATER-WETTING TREATMENT FOR REDUCING WATER CONING IN AN OIL RESERVOIR

[75] Inventors: Kenneth E. Kisman; Boyd Russell, both of Calgary, Canada

[73] Assignee: Alberta Oil Sands Technology and Research Authority, Edmonton, Canada

[21] Appl. No.: 538,316

[22] Filed: Jun. 15, 1990

[30] Foreign Application Priority Data

Jun. 16, 1989 [GB] United Kingdom ..... 8913832

[51] Int. Cl.[5] ..... E21B 43/32

[52] U.S. Cl. ..... 166/305.1

[58] Field of Search ..... 166/279, 305.1, 312

[56] References Cited

U.S. PATENT DOCUMENTS

| | | | |
|---|---|---|---|
| 3,547,199 | 12/1970 | Froning et al. | 166/305.1 |
| 3,777,820 | 12/1973 | Weaver et al. | 166/305.1 |
| 3,830,302 | 8/1974 | Dreher et al. | 166/294 |
| 3,881,552 | 5/1975 | Hessert | 166/294 |
| 4,130,165 | 12/1978 | Fast et al. | 166/305.1 X |
| 4,476,931 | 10/1984 | Boles et al. | 166/294 |

*Primary Examiner*—William P. Neuder

*Attorney, Agent, or Firm*—Millen, White & Zelano

[57] ABSTRACT

An oil well producing water is treated to reduce the water cut by injecting through the well into the reservoir a composite slug comprising:

a relatively small volume of water-wetting agent in liquid form, said agent being adapted to modify the reservoir matrix to increase its water-wetted character; and a relatively large volume of non-condensable gas for further laterally extending the matrix surface modification.

5 Claims, No Drawings

WATER-WETTING TREATMENT FOR REDUCING WATER CONING IN AN OIL RESERVOIR

FIELD OF THE INVENTION

This invention relates to a method for suppressing water coning in an oil well.

BACKGROUND OF THE INVENTION

Water coning is a phenomenon which commonly occurs with respect to producing wells having an underlying aquifer. Both oil, from the reservoir in which the well is completed, and water, from the underlying strata, have a tendency to move toward the low pressure sink created by the well. As the relative permeability of the formation rook or sand (the "matrix") immediately adjacent the well bore is greater for water than it is for oil, the water will move more easily through the material and will tend to inhibit oil migration there through.

If a well is first placed on production with little or no water production and then the water "cut" in due course suddenly begins to steadily increase, the usual explanation is that "water coning" has occurred.

It is the purpose of the present invention to provide a method for suppressing or reducing water coning.

SUMMARY OF THE INVENTION

In accordance with the present invention, an oil producing well, experiencing water coning, is treated by injecting through the well into the oil reservoir a composite slug comprising:

- a relatively small volume of water-wetting agent in liquid form, said agent being adapted to modify the reservoir matrix to increase its water-wetted character; and
- a relatively large volume of non-condensible gas for further laterally extending the matrix surface modification.

Typically, 10 $m^3$ of water-wetting agent and 50,000 to 200,000 $m^3$ of non-condensible gas are injected. When a well treated in this fashion is placed back on production, it is found that the water cut is significantly reduced.

The water-wetting agents we use are conventional and are known to have this property. Typically, they are mixtures of alcohols and light hydrocarbons, e.g., xylene or heavy aromatic naphtha. A typical non-condensible gas that is suitable for this treatment is natural gas.

DESCRIPTION OF A PREFERRED EMBODIMENT

The invention is illustrated by the following examples.

EXAMPLE I

Well No. 3 had been producing approximately 0.5 $m^3$/d oil with an 97% water cut. This well received a water wetting treatment which consisted of injecting into the formation 10 $m^3$ of 85% NP730 TM and 15% Super A-SOL TM (available from Welchem Canada Ltd., Box 101, 1404 Eighth Street, Nisku, Alberta TOC 260, or Welchem, Inc. WA 350). NP730 is a blend of asphaltene solvents coupled with a surface-active miscible solvent. It comprises xylene, methanol, isopropanol, and heavy aromatic naphtha. Super A-SOL is a blend of aromatic solvents (methanol, xylene, isopropanol, and ethyl alcohol). Bulletins describing these products in greater detail are appended and incorporated herewith. This liquid mixture was pushed into the formation with 46,000 $m^3$ of natural gas. During injection, the formation parting pressure was never exceeded. Following the treatment, the well was shut in for two days and then placed on production. Following the treatment, well #3 produced approximately 7 $m^3$/d oil with less than 40% water cut.

EXAMPLE II

Well #4 had been producing approximately 0.5 $m^3$/d oil with an 85% water cut. This well received a water wetting treatment which consisted of injecting into the formation 10 $m^3$ of 85% NP730* and 15% Super A-SOL (available from Welchem Inc. WA 350). This mixture was pushed into the formation with 50,000 $m^3$ of natural gas. During injection, the formation parting pressure was never exceeded. Following the treatment, the well was shut in for two days then placed on production. Following the treatment, Well #4 produced approximately 7 $m^3$/d oil with less than 50% water cut.

The invention is described in a paper entitled "AWACT: Anti Water Coning Technology" by W. R. Freeborn, F. A. Skoreyko and R. W. Luhning. The paper was presented at the Oil Sands 2000 conference in Edmonton on March 26–28, 1990, and was published by Alberta Oil Sands Technology and Research Authority of Edmonton. The paper is incorporated herein by reference.

The embodiments of the invention in which an exclusive property or privilege is claimed are defined as follows:

1. A method for treating an oil well completed in an oil reservoir, said well producing water, to reduce its water out, comprising:

injecting through the well into the oil reservoir a relatively small amount of water wetting agent in liquid form and a relatively large amount of natural gas; and then placing the well back on production.

2. A method for treating an oil well completed in an oil reservoir, said well producing water and oil, to reduce the water out of its production, comprising:

injecting through the well into the oil reservoir a relatively small amount of water-wetting agent in liquid form and a relatively large amount of non-condensible gas, said water-wetting agent being provided in an amount in the order of 10 $m^3$ and the gas in an amount in the range 50,000 to 200,000 $m^3$.

3. The method as set forth in claim 2 wherein:

the water-wetting agent is injected first and is followed by the gas.

4. The method as set forth in claim 2 wherein:

the gas is natural gas.

5. The method as set forth in claim 4 wherein:

the amount of water-wetting agent is 10 $m^3$.

* * * * *